US011982482B2

(12) United States Patent
Kim

(10) Patent No.: US 11,982,482 B2
(45) Date of Patent: May 14, 2024

(54) DEVICE FOR PROCESSING ICE FOR ICE BEER AND METHOD FOR MANUFACTURING ICE BEER

(71) Applicant: ERMACDANG, Seoul (KR)

(72) Inventor: Jin Hee Kim, Seoul (KR)

(73) Assignee: ERMACDANG, Seoul (KR)

( * ) Notice: Subject to any disclaimer, the term of this patent is extended or adjusted under 35 U.S.C. 154(b) by 321 days.

(21) Appl. No.: 17/594,988

(22) PCT Filed: May 8, 2020

(86) PCT No.: PCT/KR2020/006135

§ 371 (c)(1),
(2) Date: Nov. 4, 2021

(87) PCT Pub. No.: WO2021/080104

PCT Pub. Date: Apr. 29, 2021

(65) Prior Publication Data

US 2022/0307751 A1 Sep. 29, 2022

(30) Foreign Application Priority Data

Oct. 22, 2019 (KR) ..... 10-2019-0131522

(51) Int. Cl.
*F25C 1/142* (2018.01)
*F25C 5/04* (2006.01)

(52) U.S. Cl.
CPC ..... *F25C 1/142* (2013.01); *F25C 5/046* (2013.01); *F25C 2400/02* (2013.01); *F25C 2400/14* (2013.01)

(58) Field of Classification Search
CPC .. F25C 1/142; F25C 1/14; F25C 5/046; F25C 5/043; F25C 5/02; F25C 5/04; F25C 5/12;
(Continued)

(56) References Cited

U.S. PATENT DOCUMENTS

2008/0099502 A1* 5/2008 Lewitus ..... A23G 9/045 221/150 R
2013/0192290 A1 8/2013 Chudaska et al.

FOREIGN PATENT DOCUMENTS

DE 0504735 A2 * 9/1992
KR 20090113137 A * 10/2009
(Continued)

OTHER PUBLICATIONS

English translation of Yoo (KR 20170110991 A). (Year: 2017).*
(Continued)

*Primary Examiner* — Miguel A Diaz
(74) *Attorney, Agent, or Firm* — AVEK IP, LLC

(57) ABSTRACT

A device for processing ice for ice beer comprising a body, a pair of installation tables, an ice-making unit having a cylindrical shape, and rotatable shafts being formed on the ice-making unit. The outer surface of the ice-making unit is maintained at a sub-freezing temperature. There is a driving unit configured to rotate the shafts, a storage unit positioned below the ice-making unit, and a storage space concavely formed in an upper surface of the storage unit. A supply unit installed on the body to store and drop beer. A pulverizing unit is plate shaped and an end thereof is adjacent to the ice-making unit. Beer is supplied from the supply unit to the storage space. The ice-making unit is rotated to contact the beer and form a beer ice layer thereon. The pulverizing unit separates the beer ice layer from the ice-making unit.

10 Claims, 5 Drawing Sheets

(58) Field of Classification Search
CPC ..... F25C 2400/02; F25C 2400/14; A61K 2800/85; A47J 31/00; A23G 9/045
See application file for complete search history.

(56) References Cited

FOREIGN PATENT DOCUMENTS

| | | | | |
|---|---|---|---|---|
| KR | 200474562 | Y1 | * | 9/2014 |
| KR | 20150142288 | A | | 12/2015 |
| KR | 20170003707 | U | | 10/2017 |
| KR | 20170110991 | A | * | 10/2017 |
| KR | 20170110991 | A | | 10/2017 |
| KR | 101816476 | B1 | | 2/2018 |
| KR | 102087581 | B1 | | 3/2020 |
| KR | 20200113340 | A | * | 10/2020 |

OTHER PUBLICATIONS

English translation of Kim (KR 200474562 Y1). (Year: 2014).*
English translation of Yang (KR 20090113137 A). (Year: 2009).*
English translation of Kim (KR 20200113340 A). (Year: 2020).*
English translation of Schill (EP 0504735 A2). (Year: 1992).*
International Search Report and Written Opinion (with English translation), dated Aug. 3, 2020, 10 pages, issued in PCT Application No. PCT/KR2020/006135.

* cited by examiner

DEVICE FOR PROCESSING ICE FOR ICE BEER AND METHOD FOR MANUFACTURING ICE BEER

CROSS-REFERENCE TO RELATED APPLICATIONS

This application is the U.S. national phase of, and claims priority to, International Application No. PCT/KR2020/006135, filed May 8, 2020, which designated the U.S., and which claims priority to Korean Patent Application No. 10-2019-0131522, filed Oct. 22, 2019.

TECHNICAL FIELD

The invention relates to a device for processing ice for ice beer and a method for manufacturing ice beer, and more particularly, to a device for processing ice for ice beer and a method for manufacturing ice beer, which can easily produce ice and provide cool and tasty beer using ice.

BACKGROUND ART

Drinks are easy to lose their real flavors according to a change in temperature. For instance, in case of beer, consumers find it hard to enjoy flavor ingredients in beer if temperature is too low, but cannot obtain inherent refreshment of beer if temperature is high. In general, consumers can enjoy the real flavor of beer when drinking cool beer. If beer is lukewarm, lots of beer suds are generated, but if beer is too cool, there are no beer suds and consumers may feel bland taste of beer since palate is benumbed. Especially, draft beer can keep the best taste and freshness at 4° C. to 6° C.

Meanwhile, consumers may drink draft beer at stores, such as restaurants and draft beer bars having fixed stands. Here, draft beer to be sold is stored in a beer supply tank, and is poured into a container, for instance, a beer glass, through a dispenser to be provided to a consumer. Consumers want to drink cooled draft beer. So, there are tries to provide beer which meets the consumers' needs.

Draft beer which is stored in a supply tank is stored in a refrigerator and is cooled together with the supply tank. The cooled draft beer stored in the supply tank is mixed with compressed gas of a carbon dioxide gas tank to be released. However, in order to store the supply tank, in which draft beer is stored, in the refrigerator, a very big refrigerator is required and it takes long time to cool draft beer. So, the cost of using electricity is increased. Moreover, the container to contain draft beer is cooled in the refrigerator, but room temperature rises easily.

Accordingly, the disclosure may have been made in an effort to solve the above-mentioned problems occurring in the prior arts at least in part, and it may be an object of the disclosure to provide a device for processing ice for ice beer and a method for manufacturing ice beer, which can directly generate and pulverize ice when ice is needed, and can easily supply processed ice into a container in which beer is contained.

It is another object of the present invention is to provide a device for processing ice for ice beer and a method for manufacturing ice beer, which can improve the flavor of beer contained in a container using ice prepared.

The technical problem to be solved by the device for processing ice for ice beer and the method for manufacturing ice beer according to the present invention is not limited to the technical problem as mentioned above, and another technical problem, which is not mentioned, could be clearly understood by those having ordinary skill in the art to which the present invention pertains based on the description below.

Summary

To achieve the above objects, the present invention may provide a device for processing ice for ice beer according to an embodiment including: a body which is positioned in the vertical direction and has a pair of installation tables formed on the upper portion of one side of the body to be spaced apart from and in parallel to each other; an ice-making unit formed in a cylindrical shape, including shafts, which are respectively formed on both longitudinal ends thereof and are respectively connected to the installation tables to be rotatable, and having the outer peripheral surface maintained at sub-zero temperature; a driving unit connected to any one of the shafts and installed on the installation tables so as to rotate the shaft; a storage unit which is positioned between the installation tables below the ice-making unit and has a storage space being concavely formed on the upper surface of the storage unit such that a part of the ice-making unit is inserted therein; a supply unit installed on the upper portion of the body to be positioned between the installation tables and between the ice-making unit and the body, thereby storing and dropping beer; and a pulverizing unit formed in a plate shape and positioned between the installation tables such that a longitudinal end thereof is adjacent to the outer peripheral surface of the ice-making unit, wherein beer is supplied from the supply unit to the storage space, the ice-making unit is rotated by the driving unit so as to contact the beer, a beer ice layer is formed on the outer peripheral surface of the ice-making unit, and the pulverizing unit contacts the beer ice layer so as to pulverize the beer ice layer and separate the beer ice layer from the ice-making unit.

Moreover, the device for processing ice for ice beer according to an embodiment further may include a guiding unit formed in a plate shape and positioned between the installation tables to connect the installation tables and to be spaced apart from the pulverizing unit. The beer ice layer is pulverized by the pulverizing unit, is separated from the ice-making unit, and is guided between the pulverizing unit and the guiding unit.

Furthermore, the storage space may be positioned below the ice-making unit and the supply unit. The supply unit may include: a supply storage unit formed in a cup shape to receive and store beer; and a supply control unit positioned above the storage space between the installation tables and between the ice-making unit and the body in order to open the bottom surface of the supply storage unit when the supply storage unit is positioned on the upper surface thereof, wherein in the state where the bottom surface of the supply storage unit is opened by the supply control unit, beer drops toward the storage space from the supply storage unit through the supply control unit and flows into the storage space.

Additionally, the supply storage unit may be separated from the supply control unit, so that the bottom surface of the supply storage unit may be closed.

In addition, a plurality of pulverizing guides may be formed at one longitudinal end of the pulverizing unit to extend toward the outer peripheral surface of the ice-making unit and to be spaced apart from one another along the longitudinal end of the pulverizing unit.

Moreover, the inner surface of the storage space may be a curvature corresponding to a curvature of the outer peripheral surface of the ice-making unit.

Furthermore, the device for processing ice for ice beer according to an embodiment may further include a supply guiding unit which is positioned below the supply unit to correspond to the supply unit and extends toward the upper surface of the storage space to receive the beer dropping down from the supply unit and guide the beer to the storage space.

Additionally, a drain hole may be formed in the middle of the inner surface of the storage space, and a flow rate of the beer drained through the drain hole from the storage space may be smaller than that of the beer supplied to the storage space.

In addition, the ice-making unit may contact the beer to form the beer ice layer, and rotates so that the formed beer ice layer meets the body, the supply unit and the pulverizing unit in order from the storage unit.

In another aspect of the present invention, the present invention may provide a device for processing ice for ice beer according to an embodiment including: a body which is formed in a cuboid shape, is positioned in the vertical direction and has a pair of installation tables formed on the upper portion of one side of the body in a cuboid shape to be spaced apart from and in parallel to each other; an ice-making unit formed in a cylindrical shape, including shafts, which are respectively formed on both longitudinal ends thereof and are respectively connected to the installation tables to be rotatable in a space between the installation tables of which the upper portion is opened, and having the outer peripheral surface maintained at sub-zero temperature; a driving unit connected to any one of the shafts and installed on the installation tables so as to rotate the shaft; a storage unit which is positioned between the installation tables below the ice-making unit and has a storage space being concavely formed on the upper surface of the storage unit such that a part of the ice-making unit is inserted therein; a supply unit installed on the upper portion of the body to be positioned between the installation tables and between the ice-making unit and the body, thereby storing and dropping beer; a pulverizing unit formed in a plate shape and positioned between the installation tables such that a longitudinal end thereof is adjacent to the outer peripheral surface of the ice-making unit; and a guiding unit formed in a plate shape and positioned between the installation tables to connect the installation tables and to be spaced apart from the pulverizing unit to surround the pulverizing unit. A cup cooled at sub-zero temperature is filled with the beer, and is positioned between the pulverizing unit and the guiding unit below the pulverizing unit and the guiding unit. A plurality of pulverizing guides of a wedge shape are positioned on one longitudinal end of the pulverizing unit to extend toward the outer peripheral surface of the ice-making unit and to be spaced apart from one another along one end of the pulverizing unit. An interval between the longitudinal ends of the pulverizing guides and the outer peripheral surface of the ice-making unit is smaller than a thickness of a beer ice layer which will be formed on the outer peripheral surface of the ice-making unit. The beer is supplied to the storage space from the supply unit, the ice-making unit contact the beer in the storage space while rotating by the driving unit, the beer ice layer is formed on the outer peripheral surface of the ice-making unit, the pulverizing guides respectively contact the beer ice layers to separate the beer ice layers from the outer peripheral surface of the ice-making unit in response to the width of the pulverizing guides. The separated beer ice layers are guided between the pulverizing unit and guiding unit and drop down along the pulverizing unit to be put on the beer contained in a cup. The part of the ice-making unit from which the beer ice layers are separated by the pulverizing guides is inserted into the storage space of the storage unit and contacts beer to freeze the beer again so that the beer ice layer is formed.

In a further aspect of the present invention, the present invention may provide a method for manufacturing ice beer including the steps of: (a) cooling a container at sub-zero temperature; (b) supplying beer to the container to partially fill up the container; and (c) pulverizing ice and supplying the pulverized ice to the remaining part of the container to which beer is supplied.

BRIEF DESCRIPTION OF THE DRAWINGS

In order to fully understand drawings cited in the present invention, brief description of the figures will be provided.

DETAILED DESCRIPTION

Embodiments of the present invention are capable of various modifications and alternative forms, and particular embodiments of the present invention will be illustrated in the attached drawings and described in this specification in detail. It should be understood, however, that there is no intent to limit example embodiments of the invention to the particular forms disclosed, but on the contrary, example embodiments of the invention are to cover all modifications, equivalents, and alternatives falling within the technical idea and scope of the present invention.

In description of the present invention, when it is determined that detailed description of known techniques involved in the invention makes the gist of the invention obscure, the detailed description thereof will not be made. In addition, numerals (e.g., first, second, etc.) used in the description process of the present specification are merely identification symbols for distinguishing one component from another component.

Moreover, in this specification, when one component is referred to as "connected" or "coupled" with another component, the one component may be directly connected or directly coupled to the other component, but unless otherwise defined herein, it is to be understood that it may be connected or coupled via another component in the middle.

Furthermore, a component expressed as '~unit' may be one component that two or more components are combined into one component or at least two components that one component is divided into two or more for each function. Each of the components to be described below may additionally perform some or all of the functions of other components in addition to the main functions of the components, and some of the main functions of each component may be carried out exclusively by another component.

Hereinafter, preferred embodiments of the present invention will be described in detail in turn.

Figure 1:
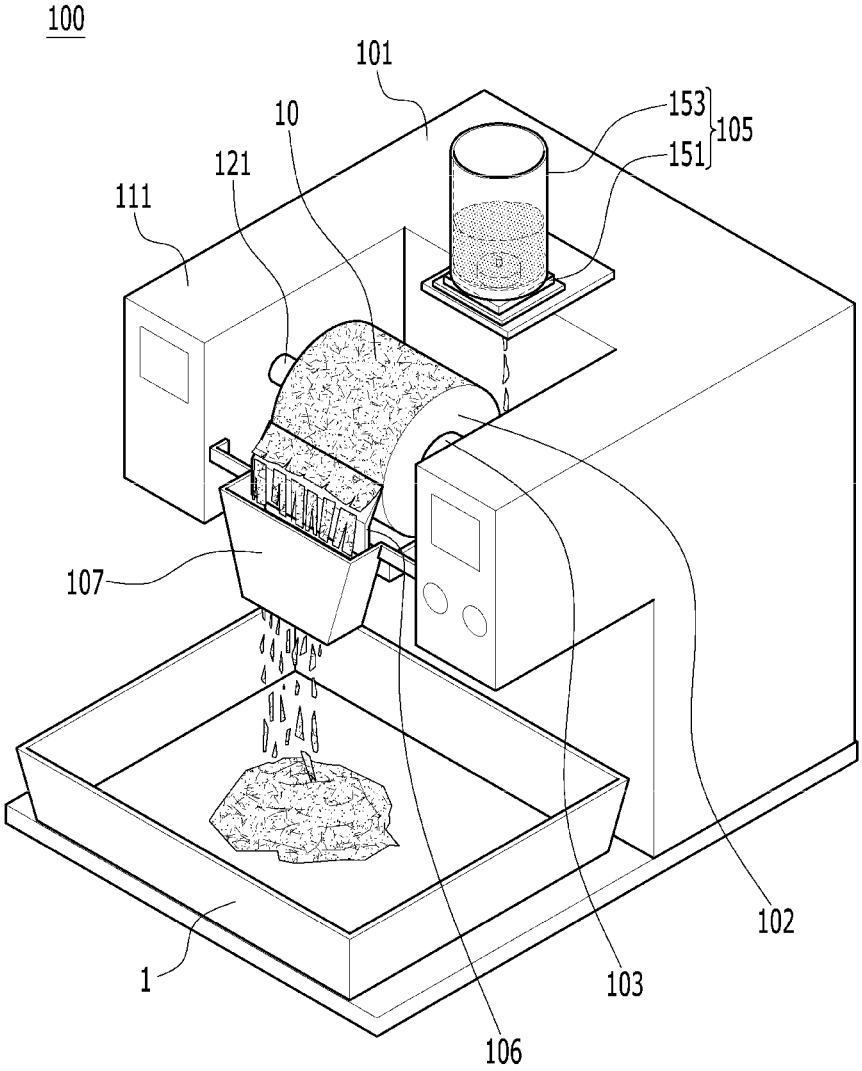
FIG. 1 is a perspective view illustrating a device for processing ice for ice beer according to a first preferred embodiment of the present invention.
Figure 2:
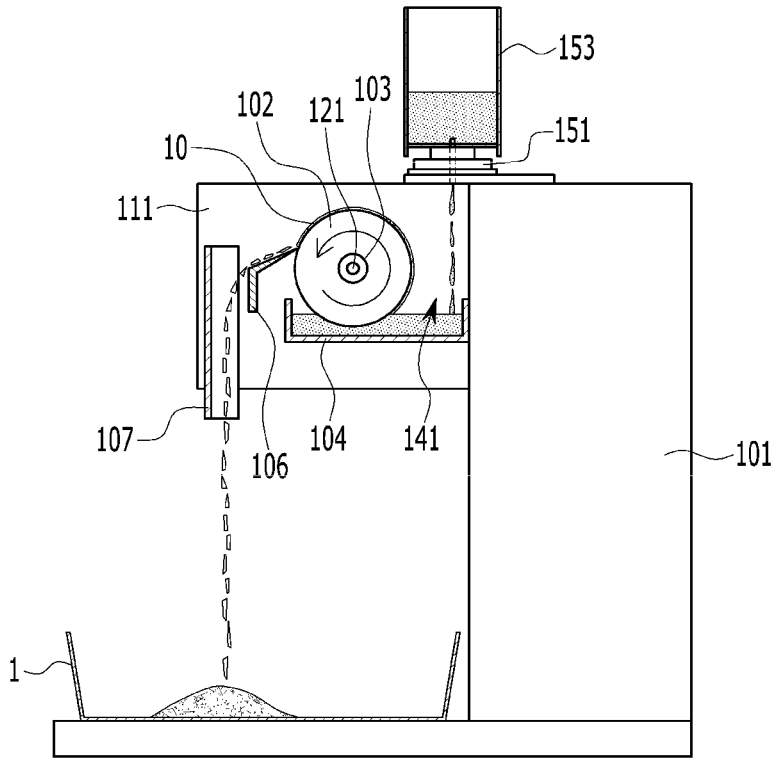
FIG. 2 is a side sectional view illustrating the device for processing ice for ice beer according to the first preferred embodiment of the present invention.

FIG. 1 is a perspective view illustrating a device 100 for processing ice for ice beer according to a first preferred embodiment of the present invention, and FIG. 2 is a side sectional view illustrating the device 100 for processing for ice beer according to the first preferred embodiment of the present invention.

As illustrated in FIGS. 1 and 2, the device 100 for processing ice for ice beer according to the first preferred embodiment of the present invention includes a body 101, an ice-making unit 102, a driving unit 103, a storage unit 104, a supply unit 105, a pulverizing unit 106, and a guiding unit 107, and is used to generate and pulverize ice so that the ice can be mixed with beer. Ice in this embodiment is processed from beer that is frozen, but is not limited to the above, and may be processed from water that is frozen. Here, the ice processed from water may be suppled not only to beer but also to soda water, mineral water, juice, and other drinks to be mixed with them.

The body 101 is formed in a cuboid shape and is positioned in the vertical direction. Here, the body 101 may be positioned to be at right angles to the upper surface of a table or a worktable.

Installation tables 111 are formed on the upper portion of one side of the body 101. Here, the installation tables 111 are formed in a cuboid shape, and is positioned to be spaced apart from and in parallel to each other. The upper surfaces of the installation tables 111 are positioned to be on the same level with the upper surface of the body 101.

The ice-making unit 102 is formed in a cylindrical shape, and has shafts 121 respectively formed in the middle of both longitudinal ends thereof. Here, the ice-making unit 102 is positioned between the installation tables 111, and the shafts 121 are respectively connected to the installation tables 111 to be rotatable. Thereby, the ice-making unit 102 may be rotated around the shafts 121 formed in the middle of both longitudinal ends between the installation tables 111.

Moreover, the ice-making unit 102 may have the outer peripheral surface which is cooled and is maintained at sub-zero temperature. Here, a cooling device (not shown) may be mounted inside the ice-making unit 102. The cooling device may be connected to a controller (not shown) mounted in the body 101 and be controlled by the controller.

The driving unit 103 is connected to any one of the shafts 121 and is mounted on the installation tables 111. Here, the driving unit 103 may rotate the shafts 121. That is, the driving unit 103 may rotate the shafts 121 to rotate the ice-making unit 102. The controller mounted in the body 101 may actuate the driving unit 103.

The storage unit 104 is positioned between the installation tables 111 below the ice-making unit 102. Here, the storage unit 104 is formed in a cuboid shape having a width and a length corresponding to a space formed between the installation tables 111, and has a storage space being concavely formed on the upper surface thereof. The storage space 141 may be formed in a shape corresponding to the storage unit 104. A part of the ice-making unit 102 may be positioned to be adjacent to the inner surface of the storage space 141 and be inserted into the storage space 141.

The supply unit 105 is mounted on the upper portion of the body 101 to be positioned between the installation tables 111 and between the ice-making unit 102 and the body 101. Here, the supply unit 105 may be mounted on the upper surface of the body 101, or may be mounted on the upper portion of one side of the body 101. The supply unit 105 may store beer and drain the stored beer down. Here, the beer may drop from the supply unit 105, go toward the storage unit 104, pass through the space between the installation tables 111 and between the body 101 and the ice-making unit 102, and then, flow into the storage space 141.

Additionally, when the beer flows into the storage space 141 to form a predetermined level, a part of the ice-making unit 102 contacts the beer to freeze the beer. In this instance, the beer is frozen into ice so that a beer ice layer is formed on the outer peripheral surface of the ice-making unit 102.

Moreover, the supply unit 105 may include a supply storage unit 151 and a supply control unit 153.

The supply storage unit 151 is formed in a cup shape to receive and store beer. Here, a part of a lower side of the supply storage unit 151 may be opened and closed. When the part of the lower side of the supply storage unit 151 is closed, beer may be supplied to the supply storage unit 151 and be maintained in a stored state. However, when the part of the lower side of the supply storage unit 151 is opened, the beer stored in the supply storage unit 151 may be drained through the part of the lower side of the supply storage unit 151.

The supply control unit 153 may be positioned above the storage space 141 between the installation tables 111 and between the body 101 and the ice-making unit 102. Here, the supply storage unit 151 may be positioned on the upper surface of the supply control unit 153 so as to be connected to the supply control unit 153 or to be separated from the upper surface of the supply control unit 153.

When the supply storage unit 151 is positioned on the upper surface of the supply control unit 153, the part of the lower side of the supply storage unit 151 is opened, and the beer is drained through the part of the lower side of the supply storage unit 151 and the supply control unit 153 so as to drop toward the storage unit 104 and stably flow into the storage space 141. Meanwhile, when the supply storage unit 151 is separated from the upper surface of the supply control unit 153, the part of the lower side of the supply storage unit 151 is closed, and the beer is maintained in the state where it is stored in the supply storage unit 151.

The pulverizing unit 106 is formed in a plate shape, and is positioned in the longitudinal direction of the ice-making unit 102 between the installation tables 111. Here, the ice-making unit 102 is positioned between the body 101 and the pulverizing unit 106.

One longitudinal end of the pulverizing unit 106 is positioned to be adjacent to the outer peripheral surface of the ice-making unit 102, and an interval between one longitudinal end of the pulverizing unit 106 and the outer peripheral surface of the ice-making unit 102 is smaller than the thickness of the beer ice layer 10 which will be formed on the outer peripheral surface of the ice-making unit 102. When the ice-making unit 102 of which the outer peripheral surface has the beer ice layer 10 is rotated, the pulverizing unit 106 contacts the beer ice layer 10 to pulverize the beer ice layer 10 into pieces of ice, and then, separates the pieces of ice from the outer peripheral surface of the ice-making unit 102. Here, the pieces of the beer ice layer 10 may be separated from the outer peripheral surface of the ice-making unit 102 and drop down along the pulverizing unit 106. The pieces of the beer ice layer 10 may be collected into a container 1 positioned on a table or a worktable to correspond the space between the installation tables 111. Here, the container 1 is positioned between the installation tables 111 and below the pulverizing unit 106 so as to naturally collect the pieces of the beer ice layer 10.

The guiding unit 107 is formed in a plate shape and is positioned between the installation tables 111 to connect the installation tables 111 and to be spaced apart from the pulverizing unit 106. Here, a predetermined space is formed between the guiding unit 107 and the pulverizing unit 106. The pulverizing unit 106 contacts the beer ice layer 10 to pulverize the beer ice layer 10 into pieces of ice, and separates the pieces of ice from the outer peripheral surface of the ice-making unit 102. After that, the beer ice layer 10 drops along the pulverizing unit 106 and passes between the pulverizing unit 106 and the guiding unit 107. Here, the pieces of the pulverized beer ice layer 10 may be not scattered since being blocked by the guiding unit 107 even though being separated from the pulverizing unit 106. Therefore, the guiding unit 107 makes the pieces of the pulverized beer ice layer 10 drop stably.

Furthermore, the device 100 for processing ice for ice beer according to the preferred embodiment of the present invention may be operated as follows. Beer is supplied and stored into the supply storage unit 151 of the supply unit 105. The supply storage unit 151 which stores the beer is positioned on the upper surface of the supply control unit 153, and is combined with the supply control unit 153. Here, the beer drops from the supply storage unit 151 toward the storage space 141 of the storage unit 104 through the part of the lower side of the supply storage unit 151 and the supply control unit 153. The beer flows into the storage space 141 so that the level of the beer in the storage space 141 increases more.

Additionally, a part of the ice-making unit 102 is inserted into the storage space 141 and contacts the beer flowing into the storage space 141. Here, because the outer peripheral surface of the ice-making unit 102 is at sub-zero temperature, the beer is frozen by contacting the ice-making unit 102 so that the beer ice layer 10 is formed on the outer peripheral surface of the ice-making unit 102. In addition, the ice-making unit 102 may rotate around the shafts 121 by the driving unit 103. The ice-making unit 102 rotates (in the arrow direction of FIG. 2) so that the beer ice layer 10 meets the body 101, the supply unit 105 and the pulverizing unit 106 in order from the storage unit 104. Here, the beer ice layer 10 may be formed on the whole outer peripheral surface of the ice-making unit 102.

When the ice-making unit 102 rotates, the beer ice layer 10 may contact the pulverizing unit 106. Here, the pulverizing unit 106 pulverizes the beer ice layer 10 in combination with the rotary power of the ice-making unit 102 to make pieces of ice, and then, pieces of ice are separated from the outer peripheral surface of the ice-making unit 102. The pieces of beer ice layer 10 drop along the pulverizing unit 106 and pass between the pulverizing unit 106 and the guiding unit 107. The pieces of the beer ice layer 10 are collected into the container 1 positioned to correspond to the pulverizing unit 106 below the installation tables 111, and some of the pieces may be directly supplied to a container which contains beer. In the meantime, because the ice-making unit 102 continues rotation, the part of the ice-making part 102 from which the beer ice layer 10 is separated is inserted into the storage space 141 of the storage unit 104 and contacts beer to freeze the beer so that the beer ice layer 10 may be formed again.

The ice-making unit 102 of the device 100 for processing ice for ice beer according to the preferred embodiment of the present invention continuously contacts the beer supplied to the storage unit 104 from the supply unit 105 so as to form the beer ice layer 10. The pulverizing unit 106 contacts the beer ice layer 10 formed on the ice-making unit 102 which rotates continuously to pulverize the beer ice layer 10, so that pieces of the beer ice layer 10 are collected to the container 1. So, the ice processed from beer can be continuously processed and pulverized when the need arises. Therefore, the device 100 for processing ice for ice beer according to the preferred embodiment of the present invention may easily process ice as much as necessary and easily supply ice to a container that stores beer.

Figure 3:
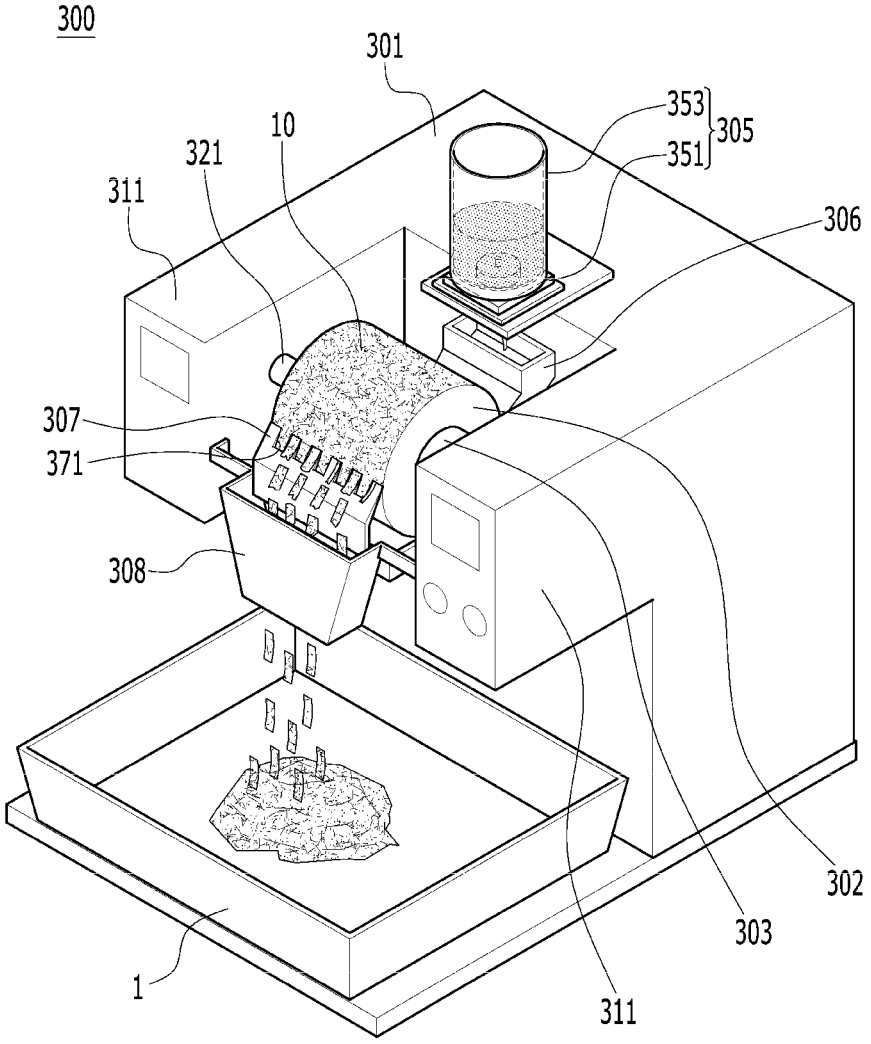
FIG. 3 is a perspective view illustrating a device for processing ice for ice beer according to a second preferred embodiment of the present invention.
Figure 4:
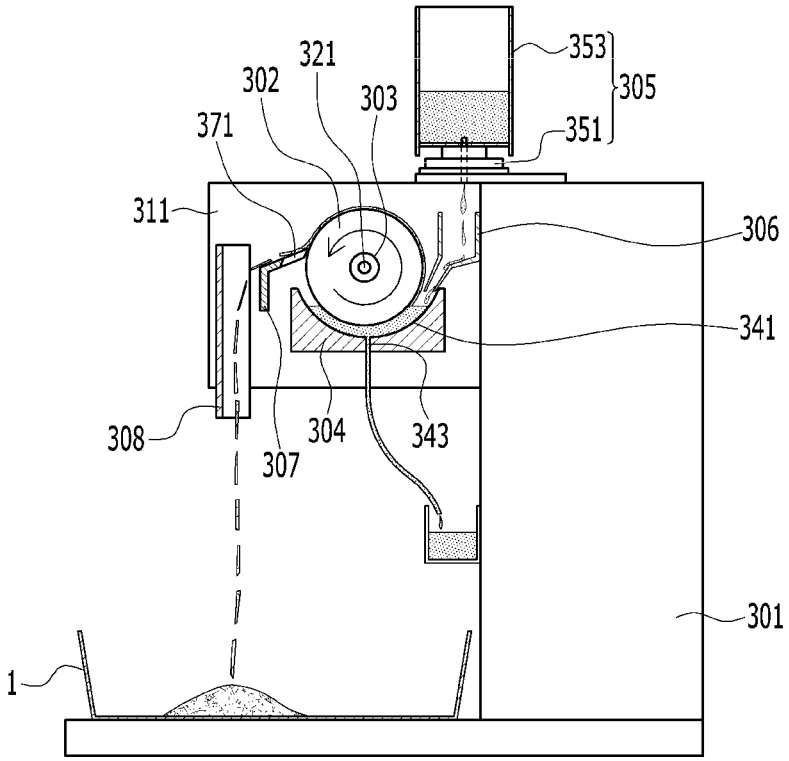
FIG. 4 is a side sectional view illustrating the device for processing ice for ice beer according to the second preferred embodiment of the present invention.

FIG. 3 is a perspective view illustrating a device for processing ice for ice beer according to a second preferred embodiment of the present invention, and FIG. 4 is a side sectional view illustrating the device for processing ice for ice beer according to the second preferred embodiment of the present invention.

As illustrated in FIGS. 3 and 4, the device 300 for processing ice for ice beer according to the second preferred embodiment of the present invention includes a body 301, an ice-making unit 302, a driving unit 303, a storage unit 304, a supply unit 305, a supply guiding unit 306, a pulverizing unit 307, and a guiding unit 308, and is used to generate and pulverize ice so that the ice can be mixed with beer. Ice in this embodiment is processed from beer that is frozen, but is not limited to the above, and may be processed from water that is frozen. Here, the ice processed from water may be suppled not only to beer but also to soda water, mineral water, juice, and other drinks to be mixed with them.

The body 301 is formed in a cuboid shape and is positioned in the vertical direction. Here, the body 301 may be positioned to be at right angles to the upper surface of a table or a worktable.

Installation tables 311 are formed on the upper portion of one side of the body 301. Here, the installation tables 311 are formed in a cuboid shape, and is positioned to be spaced apart from and in parallel to each other. The upper surfaces of the installation tables 311 are positioned to be on the same level with the upper surface of the body 301.

The ice-making unit 302 is formed in a cylindrical shape, and has shafts 321 respectively formed in the middle of both longitudinal ends thereof. Here, the ice-making unit 302 is positioned between the installation tables 311, and the shafts 321 are respectively connected to the installation tables 311 to be rotatable. Thereby, the ice-making unit 302 may be rotated around the shafts 321 formed in the middle of both longitudinal ends between the installation tables 311.

Moreover, the ice-making unit 302 has the outer peripheral surface which is cooled and is maintained at sub-zero temperature. Here, a cooling device (not shown) may be mounted inside the ice-making unit 302. The cooling device may be connected to a controller (not shown) mounted in the body 301 and be controlled by the controller.

The driving unit 303 is connected to any one of the shafts 321 and is mounted on the installation tables 311. Here, the driving unit 303 may rotate the shafts 321. That is, the driving unit 303 may rotate the shafts 321 to rotate the ice-making unit 302. The controller mounted in the body 301 may actuate the driving unit 303.

The storage unit 304 is positioned between the installation tables 311 below the ice-making unit 302. Here, the storage unit 304 is formed in a cuboid shape having a width and a length corresponding to a space formed between the installation tables 311, and has a storage space 341 being concavely formed on the upper surface thereof.

A part of the ice-making unit 302 is positioned to be adjacent to the inner surface of the storage space 341 and is inserted into the storage space 341. The inner surface of the storage space 341 has a curvature corresponding to a curvature of the ice-making unit 302. Here, the outer peripheral surface of a part of the ice-making unit 302 and the inner surface of the storage space 341 may be positioned to be spaced apart from each other at a regular interval. Thereby, when beer in the same amount as the beer supplied to the storage space 141 of the first preferred embodiment is supplied to the storage space 341 the beer may be stored in the storage space 341 to be in a higher level than in the storage space 141 of the first preferred embodiment. In a state where a part of the ice-making unit 302 is inserted into the storage space 341, the ice-making unit 302 has a wider contact area where the ice-making unit 302 contacts beer and may be used to form a beer ice layer 10 stably.

Moreover, the storage space 341 has a drain hole 343 formed in the inner surface thereof. Here, the drain hole 343 is formed in the middle of the inner surface of the storage space 341. So, beer which is stored in the storage space 341 may be drained from the storage space 341 through the drain hole 343. Especially, because the inner surface of the storage space 341 has a curved shape having a curvature corresponding to a curvature of the ice-making unit 302 and the drain hole 343 is formed in the middle of the inner surface of the storage space 341, beer may be induced into the storage space 341 and flow toward the drain hole 343. Here, the drain hole 343 may be formed such that a flow rate of the beer drained through the drain hole 343 ranges from 20% to 50% of a flow rate of the beer induced into the storage space 341. When beer is supplied to the storage space 341, it may not run over the storage space 341. Furthermore, the beer induced into the storage space 341 may be first drained through the drain hole 343. When beer is continuously supplied to the storage space 341, beer which was supplied to the storage space 341 a long time ago may not remain in the storage space 341. If beer is not supplied to the storage space 341, the beer may be completely drained out of the storage space 341. So, beer may be maintained in the storage space 341 fresh and be used to form the beer ice layer 10. Meanwhile, the beer may be collected separately after passing through the drain hole 343.

The supply unit 305 is mounted on the upper portion of the body 301 to be positioned between the installation tables 311 and between the ice-making unit 302 and the body 301. Here, the supply unit 305 may be mounted on the upper surface of the body 301, or may be mounted on the upper portion of one side of the body 301. The supply unit 305 may store beer and drain the stored beer down. Here, the beer may drop from the supply unit 305, and pass through the space between the installation tables 311 and between the body 301 and the ice-making unit 302.

Moreover, the supply unit 305 may include a supply storage unit 351 and a supply control unit 353.

The supply storage unit 351 is formed in a cup shape to receive and store beer. Here, a part of a lower side of the supply storage unit 351 may be opened and closed. When the part of the lower side of the supply storage unit 351 is closed, beer may be supplied to the supply storage unit 351 and be maintained in a stored state. However, when the part of the lower side of the supply storage unit 351 is opened, the beer stored in the supply storage unit 351 may be drained through the part of the lower side of the supply storage unit 351.

The supply control unit 353 may be positioned between the installation tables 311 and between the body 301 and the ice-making unit 302. Here, the supply storage unit 351 may be positioned on the upper surface of the supply control unit 353 so as to be connected to the supply control unit 353 or to be separated from the upper surface of the supply control unit 353.

When the supply storage unit 351 is positioned on the upper surface of the supply control unit 353, the part of the lower side of the supply storage unit 351 is opened, and the beer is drained through the part of the lower side of the supply storage unit 351 and the supply control unit 353 and drop down. In the meantime, when the supply storage unit 351 is separated from the upper surface of the supply control unit 353, the part of the lower side of the supply storage unit 351 is closed, and the beer is maintained in the state where it is stored in the supply storage unit 351.

The supply guiding unit 306 is positioned below the supply unit 305 to correspond to the supply unit 305 and extends toward the upper surface of the storage space 341. The beer may drop down from the supply unit 305 to be supplied to the supply guiding unit 306, and flow into the storage space 341 through the supply guiding unit 306.

If the inner surface of the storage space 341 has a curvature corresponding to a curvature of the ice-making unit 302 as described above, the storage space 341 of this embodiment may be positioned to correspond to the ice-making unit 302, but may not be positioned to correspond to the supply unit 305. Here, when the beer drops down from the supply unit 305, it may be difficult to flow into the storage space 341. However, the supply guiding unit 306 may receive the beer dropping from the supply unit 305 and guide the beer into the storage space 341 stably.

Additionally, when the beer flowing into the storage space 341 forms a predetermined level, a part of the ice-making unit 302 contacts the beer to freeze the beer. Here, the beer may be formed into ice so as to form a beer ice layer 10 on the outer peripheral surface of the ice-making unit 302.

The pulverizing unit 307 is formed in a plate shape, and is positioned in the longitudinal direction of the ice-making unit 302 between the installation tables 311. Here, the ice-making unit 302 is positioned between the body 301 and the pulverizing unit 307.

A plurality of pulverizing guides 371 are formed at one longitudinal end of the pulverizing unit 307 to extend toward the outer peripheral surface of the ice-making unit 302. Here, the pulverizing guides 371 are positioned to be spaced apart from one another along the longitudinal end of the pulverizing unit 307, and are positioned to be adjacent to the outer peripheral surface of the ice-making unit 302. An interval between one longitudinal end of the pulverizing guide 371 and the outer peripheral surface of the ice-making unit 302 is smaller than the thickness of the beer ice layer 10 which will be formed on the outer peripheral surface of the ice-making unit 302. When the ice-making unit 302 of which the outer peripheral surface has the beer ice layer 10 is rotated, the pulverizing guides 371 contact the beer ice layer 10 to pulverize the beer ice layer 10 into pieces of ice which correspond to the width of the pulverizing guides 371, and then, separates the pieces of ice from the outer peripheral surface of the ice-making unit 302. Here, the pieces of the beer ice layer 10 may be separated from the outer peripheral surface of the ice-making unit 302 and drop down along the pulverizing unit 307. The pieces of the beer ice layer 10 may be collected into a container 1 positioned on the table or the worktable to correspond the space between the installation tables 311, and may be formed into a regular shape by contacting the pulverizing guides 371. Moreover, the container 1 is positioned between the installation tables 311 and below the pulverizing unit 307 so as to naturally collect the pieces of the beer ice layer 10.

The guiding unit 308 is formed in a plate shape and is positioned between the installation tables 311 to connect the installation tables 311 and to be spaced apart from the pulverizing unit 307. Here, a predetermined space is formed between the guiding unit 308 and the pulverizing unit 307. The pulverizing unit 307 contacts the beer ice layer 10 to pulverize the beer ice layer 10 into pieces of ice, and separates the pieces of ice from the outer peripheral surface of the ice-making unit 302. After that, the beer ice layer 10 drops along the pulverizing unit 307 and passes between the pulverizing unit 307 and the guiding unit 308. Here, the pieces of the pulverized beer ice layer 10 may not scattered since being blocked by the guiding unit 308 even though being separated from the pulverizing unit 307. Therefore, the guiding unit 308 makes the pieces of the pulverized beer ice layer 10 drop stably.

Furthermore, the device 300 for processing ice for ice beer according to the preferred embodiment of the present invention may be operated as follows. Beer is supplied and stored into the supply storage unit 351 of the supply unit 305. The supply storage unit 351 which stores the beer is positioned on the upper surface of the supply control unit 353, and is combined with the supply control unit 353. Here, the beer is guided from the supply storage unit 351 toward the storage space 341 of the storage unit 304 through the part of the lower side of the supply storage unit 351, the supply control unit 353 and the supply guiding unit 306. The beer flows into the storage space 341 and is drained through a drain hole 343. Here, the level of the beer in the storage space 341 increases more.

Meanwhile, a part of the ice-making unit 302 is inserted into the storage space 341 and contacts the beer flowing into the storage space 341. Here, because the outer peripheral surface of the ice-making unit 302 is at sub-zero temperature, the beer is frozen by contacting the ice-making unit 302 so that the beer ice layer 10 is formed on the outer peripheral surface of the ice-making unit 302. In addition, the ice-making unit 302 may rotate around the shafts 321 by the driving unit 303. The ice-making unit 302 rotates (in the arrow direction of FIG. 4) so that the beer ice layer 10 meets the body 301, the supply unit 305 and the pulverizing unit 307 in order from the storage unit 304. Here, the beer ice layer 10 may be formed on the whole outer peripheral surface of the ice-making unit 302.

When the ice-making unit 302 rotates, the beer ice layer 10 may contact the pulverizing guides 371 of the pulverizing unit 307. Here, the pulverizing guides 371 of the pulverizing unit 307 pulverize the beer ice layer 10 in combination with the rotary power of the ice-making unit 302 to make pieces of ice, and then, pieces of ice are separated from the outer peripheral surface of the ice-making unit 302. The pieces of beer ice layer 10 drop along the pulverizing unit 307 and pass between the pulverizing unit 307 and the guiding unit 308. The pieces of the beer ice layer 10 are collected into the container 1 positioned to correspond to the pulverizing unit 307 below the installation tables 311, and some of the pieces may be directly supplied to a container which contains beer. In the meantime, because the ice-making unit 302 continues rotation, the part of the ice-making part 302 from which the beer ice layer 10 is separated is inserted into the storage space 341 of the storage unit 304 and contacts beer to freeze the beer so that the beer ice layer 10 may be formed again.

The ice-making unit 302 of the device 300 for processing ice for ice beer according to the second preferred embodiment of the present invention continuously contacts the beer supplied to the storage unit 304 from the supply unit 305 so as to form the beer ice layer 10. The pulverizing unit 307 contacts the beer ice layer 10 formed on the ice-making unit 302 which rotates continuously to pulverize the beer ice layer 10, so that pieces of the beer ice layer 10 are collected to the container 1. So, the ice processed from beer can be continuously processed and pulverized when the need arises. Therefore, the device 300 for processing ice for ice beer according to the preferred embodiment of the present invention may easily process ice as much as necessary and easily supply ice to a container that stores beer.

Figure 5:
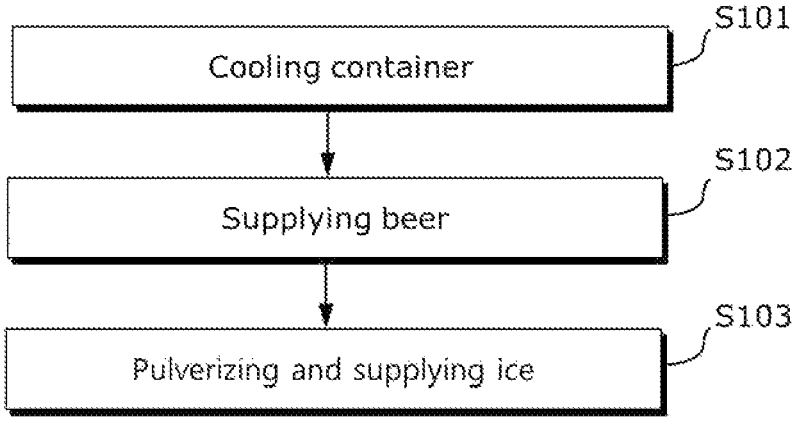
FIG. 5 is a flow chart illustrating a method for manufacturing ice beer according to a preferred embodiment of the present invention.

FIG. 5 is a flow chart illustrating a method for manufacturing ice beer according to a preferred embodiment of the present invention.

First, a step S101 of cooling the container at sub-zero temperature is carried out. In the step S101, the container is stored in a refrigerator and is cooled at sub-zero temperature, and the sub-zero temperature ranges from −20° C. to −25° C. Here, the container is cooled and reaches a cold state.

The container in the present embodiment is made of glass, and may be a cup having a handle or a cup which does not have a handle, and may have various sizes. An entrance of the container, namely, a part into which beer flows, is positioned to face up, and beer and ice can be supplied and contained into the container through the entrance of the container.

Continuously, a step S102 of supplying beer to the container is carried out. In the step S102, the container is separated from the refrigerator and is positioned outside the refrigerator. Here, beer is contained in a part of the container, and then, is supplied to the container till occupying 85% to 95% of the container's volume.

Moreover, the beer is drained from a beer supply tank and is supplied to the container. It is preferable that the beer be supplied to the container in a cooled and fresh condition.

Next, a step S103 of pulverizing ice and supplying the pulverized ice to the container is carried out. In the step S103, the container is cooled at sub-zero temperature and contains beer therein. The ice made from beer is pulverized to have particles with a size ranging from 0.5 mm to 5 mm. Some of the pulverized ice is supplied to the remaining part of the container which partially contains beer so as to fill up the container fully by being mixed with beer. In the step (S103), ice is made by the device 100 or 300 for processing ice for ice beer mentioned above, and is directly supplied to the container, which contains beer, from the device 100 or 300 for processing ice in the pulverized state.

Through the step S103) the ice makes beer cooler by being mixed with the beer in the state where it is supplied in the container, and may remain in a particle size. So, beer is contained in a container in the state where beer is mixed with the ice processed from beer to be provided to a consumer, and the consumer can feel the flavor of cool and rich beer when drinking beer.

Meanwhile, a sensory test of ice beer manufactured by the method for manufacturing ice beer according to the preferred embodiment of the present invention has been carried out. Here, an embodiment designates ice beer manufactured by the method for manufacturing ice beer according to the preferred embodiment, a comparative example 1 designates ice beer manufactured when pulverized ice was supplied to a container cooled at sub-zero temperature and beer was supplied to the container, and a comparative example 2 designates beer which was cooled at sub-zero temperature and to which ice was not supplied. Here, the beer used in the embodiment, the beer used in the comparative example 1, and the beer used in the comparative example 2 had the same amount, the same temperature and the same kind.

EMBODIMENT

First, a container was cooled at sub-zero temperature.

Next, beer was supplied to the container to partially fill up the container.

Next, ice was pulverized, and was supplied to the container partially filled with beer to fill up the remaining part of the container.

Comparative Example 1

First, a container was cooled at sub-zero temperature.

Next, ice was pulverized, and was supplied to the container to fill up a part of the container.

Next, beer was supplied to the container filled with ice in order to fill up the remaining part of the container.

Comparative Example 2

First, a container was stored and cooled at sub-zero temperature.

Next, the container was filled with beer.

The sensory test was carried out to food-related experts and 50 consumers in relation with flavor and refreshment of beers according to the embodiment, the comparative example 1 and the comparative example 2. Here, scores and evaluation standards were made using the nine-point scoring as shown in the Table 1, and evaluation results are indicated in the Table 2.

TABLE 1

| Score | Evaluation Standard |
|---|---|
| 9 | Excellent |
| 7 | Good |
| 5 | Normal |
| 3 | Bad |
| 1 | Very bad |

TABLE 2

| Division | Taste | Refreshment | General Preference |
|---|---|---|---|
| Embodiment | 8.7 | 8.5 | 8.6 |
| Comparative Example 1 | 7.9 | 7.5 | 7.7 |
| Comparative Example 2 | 3.4 | 3.2 | 3.3 |

Referring to the Table 2, it was found out that the beers contained in the containers to which pulverized ice was supplied according to the embodiment and the comparative example 1 were better in taste, refreshment and general preference than the beer contained in the container to which ice was not supplied. That is, it was confirmed that the pulverized ice improved taste and refreshment of beer.

Especially, it was found out that the embodiment provided taste and refreshment better than those of the comparative example 1 since supplying ice to the container later than beer, differently from the comparative example 1. Therefore, the method for manufacturing ice beer according to this embodiment may offer ice beer of high satisfaction level to consumers.

The device for processing ice for ice beer and the method for manufacturing ice beer according to embodiments of the present invention may have the following effects:

(1) The device for processing ice for ice beer and the method for manufacturing ice beer according to embodiments of the present invention can directly produce and pulverize ice directly when ice is needed, and can easily supply the ice into a container in which beer is contained.

(2) The device for processing ice for ice beer and the method for manufacturing ice beer according to embodiments of the present invention can improve the flavor of beer which is contained in a container using ice prepared.

However, effects which can be achieved by the device for processing ice for ice beer and the method for manufacturing ice beer according to an embodiment of the present invention are not limited to the effects described above, and other effects that are not described will be clearly understood by a person skilled in the art from the description below.

While the present invention has been particularly described with reference to preferred embodiments, the present invention is not limited thereto. It will be understood by those skilled in the art that various modifications and changes may be made without departing from the spirit and scope of the present invention.

The invention claimed is:

1. A device for processing ice for ice beer comprising:

a body which is positioned in a vertical direction and has a pair of installation tables formed on an upper portion of the body and spaced apart from and in parallel to each other;

an ice-making unit formed in a cylindrical shape, including shafts, which are respectively formed on both longitudinal ends thereof and are respectively and rotatably connected to the installation tables, and having an outer peripheral surface maintained at sub-zero temperature;

a driving unit connected to at least one of the shafts and installed on the installation tables so as to rotate the at least one shaft;

a storage unit which is positioned between the installation tables below the ice-making unit and has a storage space being concavely formed on an upper surface of the storage unit such that a part of the ice-making unit is inserted therein;

a supply unit installed on the upper portion of the body and positioned between the installation tables and between the ice-making unit and the body, thereby storing and dropping beer; and a pulverizing unit formed in a plate shape and positioned between the installation tables such that a longitudinal end thereof is adjacent to the outer peripheral surface of the ice-making unit, wherein beer is supplied from the supply unit to the storage space, the ice-making unit is rotated by the driving unit so as to contact the beer, a beer ice layer is formed on the outer peripheral surface of the ice-making unit, and the pulverizing unit contacts the beer ice layer so as to pulverize the beer ice layer and separate the beer ice layer from the ice-making unit;

wherein the storage space is positioned below the ice-making unit and the supply unit;

wherein the supply unit comprises:

a supply storage unit formed in a cup shape to receive and store beer; and a supply control unit positioned above the storage space between the installation tables and between the ice-making unit and the body in order to open a bottom surface of the supply storage unit when the supply storage unit is positioned on the upper surface thereof; and wherein in a state where the bottom surface of the supply storage unit is opened by the supply control unit, beer drops toward the storage space from the supply storage unit through the supply control unit and flows into the storage space.

2. The device according to claim 1, further comprising:

a guiding unit formed in a plate shape and positioned between the installation tables to connect the installation tables and to be spaced apart from the pulverizing unit, wherein the beer ice layer is pulverized by the pulverizing unit, is separated from the ice-making unit, and is guided between the pulverizing unit and the guiding unit.

3. The device according to claim 1, wherein the supply storage unit is separated from the supply control unit, so that the bottom surface of the supply storage unit is closed.

4. The device according to claim 1, wherein a plurality of pulverizing guides are formed at one longitudinal end of the pulverizing unit to extend toward the outer peripheral surface of the ice-making unit.

5. The device according to claim 1, wherein the ice-making unit contacts the beer to form the beer ice layer, and rotates so that the formed beer ice layer meets the body, the supply unit and the pulverizing unit in order from the storage unit.

6. The device according to claim 1, wherein an inner surface of the storage space has a curvature corresponding to a curvature of the outer peripheral surface of the ice-making unit.

7. The device according to claim 6, further comprising:

a supply guiding unit which is positioned below the supply unit to correspond to the supply unit and extends toward an upper surface of the storage space to receive the beer dropping down from the supply unit and guide the beer to the storage space.

8. The device according to claim 6, wherein a drain hole is formed in a middle of the inner surface of the storage space, and wherein a flow rate of the beer drained through the drain hole from the storage space is smaller than that of the beer supplied to the storage space.

9. A device for processing ice for ice beverage comprising:

a body which is positioned in a vertical direction and has a pair of installation tables formed on an upper portion of the body and spaced apart from and in parallel to each other;

an ice-making unit formed in a cylindrical shape, including shafts, which are respectively formed on both longitudinal ends thereof and are respectively and rotatably connected to the installation tables, and having an outer peripheral surface maintained at sub-zero temperature;

a driving unit connected to at least one of the shafts and installed on the installation tables so as to rotate the at least one shaft;

a storage unit which is positioned between the installation tables below the ice-making unit and has a storage space being concavely formed on an upper surface of the storage unit such that a part of the ice-making unit is inserted therein;

a supply unit installed on the upper portion of the body and positioned between the installation tables and between the ice-making unit and the body, thereby storing and dropping beverage; and a pulverizing unit formed in a plate shape and positioned between the installation tables such that a longitudinal end thereof is adjacent to the outer peripheral surface of the ice-making unit, wherein beverage is supplied from the supply unit to the storage space, the ice-making unit is rotated by the driving unit so as to contact the beverage, a beverage ice layer is formed on the outer peripheral surface of the ice-making unit, and the pulverizing unit contacts the beverage ice layer so as to pulverize the beverage ice layer and separate the beverage ice layer from the ice-making unit;

wherein the storage space is positioned below the ice-making unit and the supply unit;

wherein the supply unit comprises:

a supply storage unit formed in a cup shape to receive and store beverage; and a supply control unit positioned above the storage space between the installation tables and between the ice-making unit and the body in order to open a bottom surface of the supply storage unit when the supply storage unit is positioned on the upper surface thereof; and wherein in a state where the bottom surface of the supply storage unit is opened by the supply control unit, beverage drops toward the storage space from the supply storage unit through the supply control unit and flows into the storage space.

10. The device according to claim 9, wherein the beverage ice layer is pulverized by the pulverizing unit, is separated from the ice-making unit, and is guided between the pulverizing unit and a guiding unit.

* * * * *